United States Patent [19]

Higgins

[11] Patent Number: 4,801,337

[45] Date of Patent: Jan. 31, 1989

[54] PROCESS AND COMPOSITION FOR CONVERSION COATING METAL SURFACES

[75] Inventor: George Higgins, Windsor, England

[73] Assignee: Pyrene Chemical Services Limited, Buckinghamshire, England

[21] Appl. No.: 43,288

[22] Filed: Apr. 2, 1987

[30] Foreign Application Priority Data

Apr. 8, 1986 [GB] United Kingdom ..... 8608508

[51] Int. Cl.[4] ..... C23C 22/60

[52] U.S. Cl. ..... 148/6.2

[58] Field of Search ..... 148/6.2

[56] References Cited

U.S. PATENT DOCUMENTS 3,404,046 10/1968 Russell ..... 148/6.2

3,444,007 5/1969 Maurer ..... 148/6.15 R

*Primary Examiner*—Sam Silverberg

*Attorney, Agent, or Firm*—Arthur E. Kluegel

[57] ABSTRACT

An improved composition and process for forming a corrosion-resistant complex oxide coating on a zinc or zinc alloy surface incorporates in an aqueous alkaline composition of pH value greater than 11 at least three complexed polyvalent metals, one of which is trivalent chromium.

20 Claims, No Drawings

PROCESS AND COMPOSITION FOR CONVERSION COATING METAL SURFACES

BACKGROUND OF THE INVENTION

U.S. Pat. No. 3,444,007 describes a process for forming a complex oxide corrosion-resistant coating on a zinc or zinc alloy surface comprising treating the surface with an aqueous alkaline solution having a pH of at least 11 and which contains a metal of a group of the periodic system other than group 1 and that to attain desired solubility is complexed with a complexing, chelating or sequestering agent and is thus in solution. Hexavalent chromium interferes with the coating and so must be generally absent, but it is desirable to give the coating a subsequent rinse in dilute aqueous chromic acid.

It is stated that somewhat better results are obtained with compositions which contain at least two complexed metal ions. The combinations of complexed metals that are exemplified are separate combinations of ferric iron with either cobalt, magnesium, cadmium, tin, titanium, antimony, bismuth, silver, molybdenum, tungsten or manganese and separate combinations of cobalt with either arsenic or cerium. Other complexed metals that are exemplified for individual use are ferrous iron and vanadium while aluminum, chromium and nickel are mentioned as metals that can be used in the process but are not exemplified.

A process that has been used successfully involves the treatment of continuous strip galvanized steel at, for instance, above 50° C. using an alkaline solution of complexed cobalt and ferric iron, followed by a chromate rinse.

It would be desirable to improve the corrosion resistance and/or adhesion of the coating and it would be desirable to be able to obtain a good coating either using less concentrated solutions or lower coating temperatures or both.

SUMMARY OF THE INVENTION

We have now surprisingly found that these objectives can be achieved if trivalent chromium is included with at least two other polyvalent metals.

An aqueous alkaline solution according to the invention for forming a corrosion-resistant complex oxide coating on a surface of zinc or zinc alloy has a pH above 11 and contains at least three polyvalent metals (exclusive of zinc) that do not exist to any appreciable extent in the free cationic state in the alkaline solution and that are complexed with a complexing agent and are in solution, and one of the polyvalent metals is trivalent chromium.

DETAILED DESCRIPTION OF THE INVENTION

The other polyvalent metals may be any of those named in U.S. Pat. No. 3,444,007 but are preferably selected from iron, cobalt and nickel. There is particular benefit in the use of chromium when cobalt is also present, preferably in combination with iron. Best results are achieved when the solution contains, in addition to trivalent chromium, divalent cobalt and trivalent iron although useful results cn also be obtained if the cobalt is replaced wholly or in part by nickel.

The term complexing agent is intended to be generic and include so-called chelating or sequestering agents. Any suitable complexing agent or blend of complexing agents may be used. A typical complexing agent is gluconic acid but best results are generally achieved using heptonic acid. It is usually introduced in the form of a water soluble salt, especially as sodium heptonate.

It may be found that if the metals are introduced only as salts with inorganic acids, e.g. nitrate, the amount of heptonate or other complexing agent needs to be rather large for best results. Good results can be achieved with lesser amounts if at least one of the polyvalent metals is introduced in the form of a water soluble salt with an organic acid or if free organic acid (as a sodium or other salt thereof) is added to the composition. This organic acid may be a complexing agent but the preferred systems, from the point of view of cost and effectiveness, are those in which the organic acid is formic acid or acetic acid. Thus one preferred process involves introducing chromium as chromium acetate or formate, with the other polyvalent metals generally being introduced as nitrate or other suitable inorganic acid salt. Another involves the use of sodium formate or acetate in combination with inorganic acid salts of all the metals.

Although it is preferred to introduce all the polyvalent metals in the form of cations, any that can exist in the form of anions may be introduced in this state if desired.

The solution must have pH above 11, preferably above 12, with best results generally obtained at pH 12.2 to 13.3. Although a variety of alkaline compounds can be used (such as are mentioed in U.S. Pat. No. 3,444,007) it is preferred to use alkali metal hydroxide, such as sodium ydroxide. The amount will be selected to give the desired pH and typically is in the range 5 to 35 g/l.

The amount of complexing agent will depend on the amount of polyvalent metal in the solution during use, since the amount should be sufficient to complex substantially all polyvalent metals that are in the solution. Generally it is from 0.05 to 10, preferably 1 to 5, g/l when the complexing agent is sodium heptonate. Equivalent amounts of other complexing agents may be used.

The total amount of polyvalent metal ion is generally in the range 0.3 to 3 g/l, most preferably 0.4 to 1 g/l.

The amount of trivalent chromium is generally in the range 0.04 to 0.4, most preferably 0.1 to 0.3 g/l. When trivalent iron is present its amount is generally from 0.1 to 0.3 and any third metal, for instance divalent cobalt, is generally present in an amount of from 0.15 to 0.4 g/l. When acetate of other organic acid salt is to be introduced it is preferably introduced as the salt of polyvalent metal that provides 15 to 60%, preferably 20 to 40%, by weight of the total polyvalent metal ion. Alternatively the equivalent amount of free organic carboxylic acid may be introduced.

The surface that is to be treated can be any of the surfaces described in U.S. Pat. No. 3,444,007. Generally the zinc is present as a coating over iron (including steel). It may be an alloy, for instance an alloy of zinc with aluminum, generally as a coating on iron. The surface is preferably precleaned and rinsed with water before treatment.

The treatment can be by any convenient technique such as dip or, preferably, spray. Although the treatment temperature can be up to, for instance, 90° C. it is preferably below 60° C. and most preferably below 50° C. Generally it is above 20° C. Although in many processes treatment temperatures of 35° to 50° C., typically around 45° C., are preferred a particular advantage of the invention is that it is possible to obtain very good results at low temperature of 20° to 35° C., typically around 25° C.

The duration of the treatment is generally from 2 to 60 seconds, preferably 5 to 30 seconds. In general the dilute solutions require higher temperatures or longer treatment times. However a further advantage of the invention is that good results can be obtained using solutions that are more dilute than is required when the solution is free of trivalent chromium.

The solution is generally free of hexavalent chromium and it is possible to obtain satisfactory results without giving the coated surface and a subsequent chromate or post-treatment rinse, although in some instances this is desirable, generally after rinsing the coated surface with water. The surface is eventually dried, optionally after a water rinse. The dried coating can then receive paint or other coating.

As explained in U.S. Pat. No. 3,444,007 if the article that is being treated also has exposed iron or steel portions it may be desirable to give the article an acidic zinc phosphate or alkali metal phosphate coating treatment after the alkaline treatment of the invention.

The following are examples of the invention.

EXAMPLE 1

A treatment solution suitable for spray application at 45° C. for 2 to 15 seconds is made by dissolving in water the following components.

| | |
|---|---|
| $Co^{2+}$: | 0.2 $gl^{-1}$ - added as nitrate |
| $Cr^{3+}$: | 0.2 $gl^{-1}$ - added as acetate |
| $Fe^{3+}$: | 0.15 $gl^{-1}$ - added as nitrate |
| Sodium Heptonate: | 2.2 $gl^{-1}$ |
| NaOH: | 19.0 $gl^{-1}$ |

EXAMPLE 2

A treatment solution suitable for spraying at 25° C. for 2 to 15 seconds is made by dissolving in water the following components.

| | |
|---|---|
| $Co^{2+}$: | 0.3 $gl^{-1}$ - added as nitrate |
| $Cr^{3+}$: | 0.15 $gl^{-1}$ - added as acetate |
| $Fe^{3+}$: | 0.2 $gl^{-1}$ - added as nitrate |
| Sodium Heptonate: | 2.9 $gl^{-1}$ |
| NaOH: | 25.0 $gl^{-1}$ |

EXAMPLE 3

Hot dipped, galvanized steel panels having a zinc coating weight of 275 $g/m^2$ and normal spangle were precleaned, sprayed for 20 seconds at 45° C. with a solution according to Example 1, rinsed with water, rinsed in a hexavalent chromium containing rinse, and were then dried and painted with an epoxy-primer and $PVF_2$ finish coat.

These panels were cross-scored and subjected to salt-spray testing according to ASTM B117 for 1000 hours. Blistering size and density was recorded as in BS3900 part H1. At the end of the test, no blistering of the paint was apparent, there was no paint removed from the score, and little white rust was produced.

Panels processed and tested in a similar fashion, except that the processing was in a solution where the chromium content was nil, evinced blisters of density 3 and size 3. White rustbleed from the score had begun to spread over the face of the panels.

EXAMPLE 4

Panels were processed as in Example 3 but employing the treatment composition of Example 2. Upon salt spray testing for 750 hours, the test panels exhibited a creepage of 0–3 mm. This compares to a creepage of 0–5 mm for the similar composition without trivalent chromium.

What is claimed is:

1. In a process for forming a corrosion-resistant complex oxide coating on a zinc or zinc alloy surface wherein the surface is contacted with an aqueous alkaline composition having a pH value above 11 and containing a complexed polyvalent metal, the improvement comprising including in said composition at least three of said polyvalent metals, one of which is trivalent chromium.

2. A process according to claim 1 in which the polyvalent metals are trivalent chromium with at least two metals selected from iron, cobalt and nickel.

3. A process according to claim 1 in which the polyvalent metals comprise trivalent chromium, cobalt and at least one other polyvalent metal.

4. A process according to claim 1 in which the polyvalent metals comprise trivalent chromium, cobalt and iron.

5. A process according to claim 1 in which the total amount of the said polyvalent metals is 0.3 to 3 g/l and the amount of trivalent chromium is 0.04 to 0.4 g/l.

6. A process according to claim 1 in which the complexing agent comprises heptonic acid.

7. A process according to claim 1 in which the complexing agent is selected from heptonic acid, gluconic acid and their water soluble salts, and the amount of complexing agent is from 0.5 to 10 g/l.

8. A process according to claim 1 in which the solution includes an organic acid salt selected from formate and acetate in an amount that is equivalent to 15 to 60% of the total said polyvalent metal.

9. A process according to claim 1 in which the treatment is conducted at 20° to 90° C.

10. A process according to claim 1 in which the treatment is conducted at 20° to 50° C.

11. A process according to claim 1 in which the treatment is conducted by spraying the solution on to the said surface.

12. A process according to claim 1 in which the said surface is a coating on iron of a metal selected from zinc and zinc alloys.

13. In an aqueous alkaline composition suitable for forming a corrosion-resistant complex oxide coating on a zinc or zinc alloy surface exhibiting a pH vlue of at least 11 and containing a complexed polyvalent metal, the improvement comprising including at least three of said polyvalent metals, one of which is trivalent chromium.

14. A solution according to claim 13 in which the polyvalent metals are trivalent chromium with at least two metals selected from iron, cobalt and nickel.

15. A solution according to claim 13 in which the polyvalent metals comprise trivalent chromium, cobalt and at least one other polyvalent metals.

16. A solution according to claim 13 in which the polyvalent metals comprise trivalent chromium, cobalt and iron.

17. A solution according to claim 13 in which the total amount of the said polyvalent metals is 0.3 to 3 g/l and the amount of trivalent chromium is 0.04 to 0.4 g/l.

18. A solution according to claim 13 in which the complexing agent comprises heptonic acid.

19. A solution according to claim 13 in which the complexing agent is selected from heptonic acid and gluconic acid and the amount of complexing agent is from 0.05 to 10 g/l.

20. A solution according to claim 13 in which the solution includes an organic acid salt selected from formate and acetate in an amount that is equivalent to 15 to 60% of the total said polyvalent metal.

* * * * *